US006468115B2

(12) United States Patent
Kashiyama et al.

(10) Patent No.: US 6,468,115 B2
(45) Date of Patent: Oct. 22, 2002

(54) TERMINAL RETAINER-ATTACHED CONNECTOR

(75) Inventors: Motohisa Kashiyama; Takeo Kohata, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/788,620

(22) Filed: Feb. 21, 2001

(65) Prior Publication Data

US 2001/0016458 A1 Aug. 23, 2001

(30) Foreign Application Priority Data

Feb. 21, 2000 (JP) ..... 2000-043152

(51) Int. Cl.[7] ..... H01R 13/436
(52) U.S. Cl. ..... 439/752
(58) Field of Search ..... 439/752, 595

(56) References Cited

U.S. PATENT DOCUMENTS

| | | | |
|---|---|---|---|
| 5,322,456 A | 6/1994 | Yagi et al. | 439/595 |
| 5,397,249 A | 3/1995 | Endo et al. | 439/595 |

FOREIGN PATENT DOCUMENTS

| | | |
|---|---|---|
| DE | 89 01 661 U | 3/1989 |
| EP | 0 954 060 A2 | 11/1999 |
| JP | 2634537 | 4/1997 |
| WO | 98/01926 | 1/1998 |

*Primary Examiner*—Gary F. Paumen
(74) *Attorney, Agent, or Firm*—Sughrue Mion, PLLC

(57) ABSTRACT

An elastic retaining piece portion (23*a*) is formed on a terminal retainer (17), and has a completely-retaining portion (23*b*) at a distal end thereof and an engagement-canceling tapering portion (23*c*) on a distal end surface thereof. The completely-retaining portion (23*a*) is engageable with a completely-engaging portion (13*c*) of a connector housing (13) to retain the terminal retainer (17) in a completely-engaging position relative to the connector housing (13). When the engagement-canceling tapering portion (23*c*) is pressed by a removal jig (25) which has been inserted in the connector housing through a jig insertion port (13*e*) so as to be disposed substantially in alignment with the engagement-canceling tapering portion (23*c*), the elastic retaining piece portion (23*a*) is retracted while elastically deformed in a direction causing the completely-retaining portion (23*b*) to be disengaged from the completely-engaging portion (13*c*).

7 Claims, 5 Drawing Sheets

TERMINAL RETAINER-ATTACHED CONNECTOR

BACKGROUND OF THE INVENTION

1. Field of the Invention

The present invention relates to a terminal retainer-attached connector. More particularly, the present invention relates to an improved terminal retainer-attached connector comprising a connector housing, having a plurality of terminal receiving chambers, and a terminal retainer attached to the connector housing to retain metal terminals received respectively in the terminal receiving chambers.

The present application is based on Japanese Patent Application No. 2000-43152, which is incorporated herein by reference.

2. Description of the Related Art

FIG. 7 shows a related, terminal retainer-attached connector. This terminal retainer-attached connector 1 comprises a connector housing 2, having a plurality of terminal receiving chambers 2*a*, and a terminal retainer 5 which is inserted into the terminal receiving chambers 2*a* from the rear side after metal terminals 3 are inserted respectively into the terminal receiving chambers 2*a* from the rear side (left side in FIG. 7) of the housing, and are retained there, so that this terminal retainer 5 prevents the withdrawal of the metal terminals 3 properly mounted in the respective terminal receiving chambers 2*a*.

Elastic retaining piece portions 2*b*, which can engage the inserted metal terminals 3, respectively, to prevent the withdrawal of these metal terminals, are formed within the connector housing 2.

The terminal retainer 5 include elastic support piece portions 5*a*, and retaining projections 5*b*. Each elastic support piece portion 5*a* is inserted into a space between an inner surface of the connector housing 2 and the elastic retaining piece portion 2*b* to prevent the displacement of this elastic retaining piece portion 2*b* in an engagement-canceling direction, thereby preventing the accidental withdrawal of the metal terminal 3. When the amount of insertion of the elastic support piece portions 5*a* reaches the proper amount, the retaining projections 5*b* are engaged respectively in retaining holes 2*c*, formed respectively in outer walls of the connector housing 2 at the rear end portion thereof, thereby holding the terminal retainer 5 in a completely-engaged condition relative to the connector housing 2.

When any of the metal terminals 3 is incompletely mounted in the terminal receiving chamber 2*a*, so that the elastic retaining piece portion 2*b* is not completely engaged with this metal terminal 3, the elastic support piece portion 5*a* of the terminal retainer 5 can not be properly inserted, and therefore this incompletely-mounted condition of the metal terminal 3 can be detected.

In the above terminal retainer-attached connector 1, when exchanging the metal terminal 3 or adding fresh metal terminal 3, it is necessary to cancel the complete engagement of the terminal retainer 5 with the connector housing 2 so as to cancel the restraint of the elastic retaining piece portions 2*b* by the terminal retainer 5.

For canceling the retaining by the terminal retainer 5, a removal jig 6, shown in FIG. 7, is used. This removal jig 6 has a pointed distal end portion 6*a* which can be inserted into a jig retaining portion 5*c* (which is in the form of a recess) formed in each of upper and lower sides of a rear end portion of the terminal retainer 5, the jig retaining portions 5*c* being covered with the outer walls of the connector housing 2 in the completely-engaged condition of the terminal retainer 5.

For canceling the completely-engaged condition of the terminal retainer 5 so as to cancel the restraint of the elastic retaining piece portions 2*b*, the distal end portion 6*a* of the removal jig 6 is inserted into a gap between the rear end of the outer wall of the connector housing 2 and the terminal retainer 5 as indicated by arrow (A) in FIG. 7, and then the rear end portion of the terminal retainer 5 is elastically deformed so as to disengage each retaining projection 5*b* from the retaining hole 2*c*, and at the same time the distal end portion 6*a* is advanced to be engaged in the jig retaining portion 5*c*. Then, the removal jig 6 is turned upwardly in a prying manner to bring the retaining projections 5*b* out from the rear end of the connector housing 2, as shown in FIG. 8.

However, when inserting the distal end portion 6*a* of the removal jig 6 and when turning the removal jig upwardly in a prying manner as described above, an undue force acts on the connector housing 2 and the terminal retainer 5, so that the connector housing 2 and the terminal retainer can be deformed.

And besides, the operation of the removal jig 6 for canceling the retained condition of the terminal retainer 5 includes two operations, that is, the insertion of the distal end portion 6*a* and the turning movement of the removal jig, and skill is required for the smooth operation, and therefore there has been encountered a problem that the operation for removing the metal terminals 3 can not be carried out easily.

SUMMARY OF THE INVENTION

It is therefore an object of the present invention to overcome the above problems, and more specifically to provide a terminal retainer-attached connector having a good retaining structure in which a retained condition of a terminal retainer can be easily canceled when removing metal terminals, and a connector housing and the terminal retainer will not be deformed.

To achieve the above object, according to the first aspect of the present invention, there is provided a connector which comprises a connector housing including a terminal receiving chamber into which a metal terminal is insertable, a completely-engaging portion, and a jig insertion port through which a removal jig is insertable in the connector housing, a terminal retainer attachable to the connector housing to retain the metal terminal in the terminal receiving chamber, and an elastic retaining piece portion formed on the terminal retainer to extend in an attaching direction thereof, the elastic retaining piece portion having a completely-retaining portion at a distal end thereof and an engagement-canceling tapering portion on a distal end surface thereof, wherein the completely-retaining portion is engageable with the completely-engaging portion of the connector housing to retain the terminal retainer in a completely-engaging position relative to the connector housing, and when the engagement-canceling tapering portion is pressed by the removal jig inserted in the connector housing through the jig insertion port so as to be disposed substantially in alignment with the engagement-canceling tapering portion, the elastic retaining piece portion is retracted while elastically deformed in a direction causing the completely-retaining portion to be disengaged from the completely-engaging portion.

In the above construction, for canceling the completely-engaged condition of the terminal retainer so as to remove the metal terminal, the removal jig is inserted through the jig insertion port, formed in the connector housing, in a direction opposite to the direction of insertion of the terminal retainer, and the engagement-canceling tapering portion, formed at the distal end surface of the elastic retaining piece portion is pressed by a distal end of this removal jig.

When the engagement-canceling tapering portion of the elastic retaining piece portion is thus pressed by the distal end of the removal jig, the elastic retaining piece portion is retracted while elastically deformed in the direction to cause the completely-retaining portion to be disengaged from the completely-engaging portion of the connector housing, so that the completely-engaged condition of the terminal retainer relative to the connector housing is canceled.

Therefore, with only one operation, that is, merely by inserting the removal jig through the jig insertion port in the direction opposite to the direction of insertion of the terminal retainer, the terminal retainer can be easily moved from the completely-engaging position to the engagement-canceling position.

The completely-engaged condition of the terminal retainer can be canceled through the elastic deformation of the elastic retaining piece portion, and therefore an undue force will not act on the connector housing and the terminal retainer, so that the connector housing and the terminal retainer will not be deformed.

According to the second aspect of the present invention, it is preferable that the connector further comprises a restraint projection formed substantially parallel to the elastic retaining piece portion, wherein the elastic retaining piece portion cooperates with the restraint projection to hold the completely-engaging portion therebetween.

In this case, in the completely-engaged condition of the terminal retainer, the restraint projection and the elastic retaining piece portion cooperate with each other to hold the completely-engaging portion of the connector housing therebetween, and therefore the elastic retaining piece portion will not shake in the elastically deforming direction.

Therefore, the engagement of the completely-retaining portion with the completely-engaging portion will not be accidentally canceled by external vibrations or impact, so that the stable retaining force is obtained.

And besides, when the engagement-canceling tapering portion, formed at the distal end surface of the elastic retaining piece portion, is to be pressed by the distal end of the removal jig, the removal jig can be positively brought into an engaging position relative to the distal end surface of the elastic retaining piece portion, and the elastic retaining piece portion can be positively elastically deformed in the engagement-canceling direction by the pressing force applied by the inserted removal jig.

In the meantime, the terminal retainer may include a terminal holding piece portion, which engages the metal terminal to prevent displacement of the metal terminal and is prevented by an inner wall of the connector housing from being elastically deformed in an engagement-canceling direction when the terminal retainer is inserted into the completely-engaging position within the connector housing.

DETAILED DESCRIPTION OF THE PREFERRED EMBODIMENT

One preferred embodiment of a terminal retainer-attached connector of the present invention will now be described in detail with reference to FIGS. 1 to 6.

Figure 1:
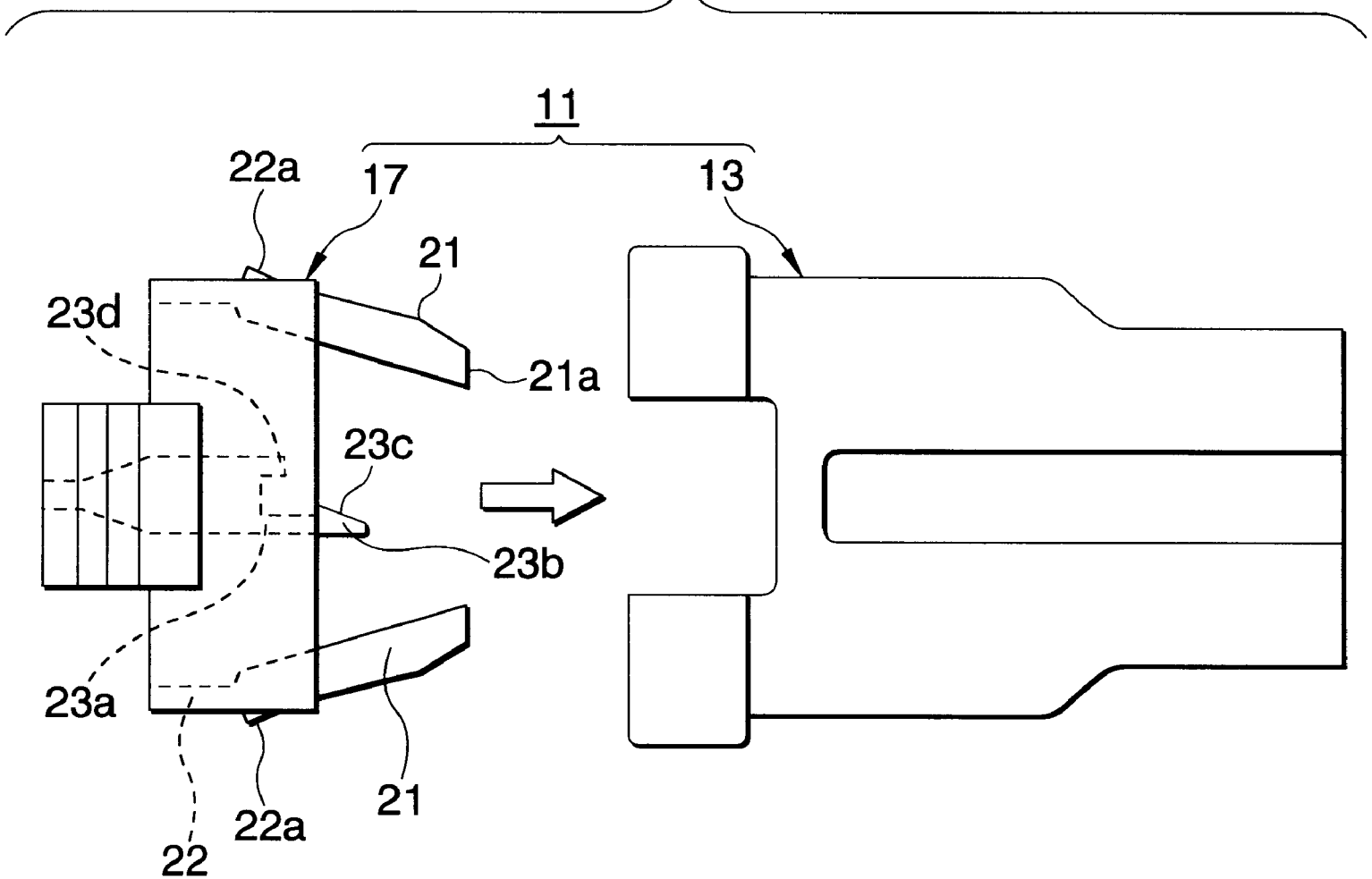
FIG. 1 is an exploded, front-elevational view of one preferred embodiment of a terminal retainer-attached connector of the present invention.
Figure 2:
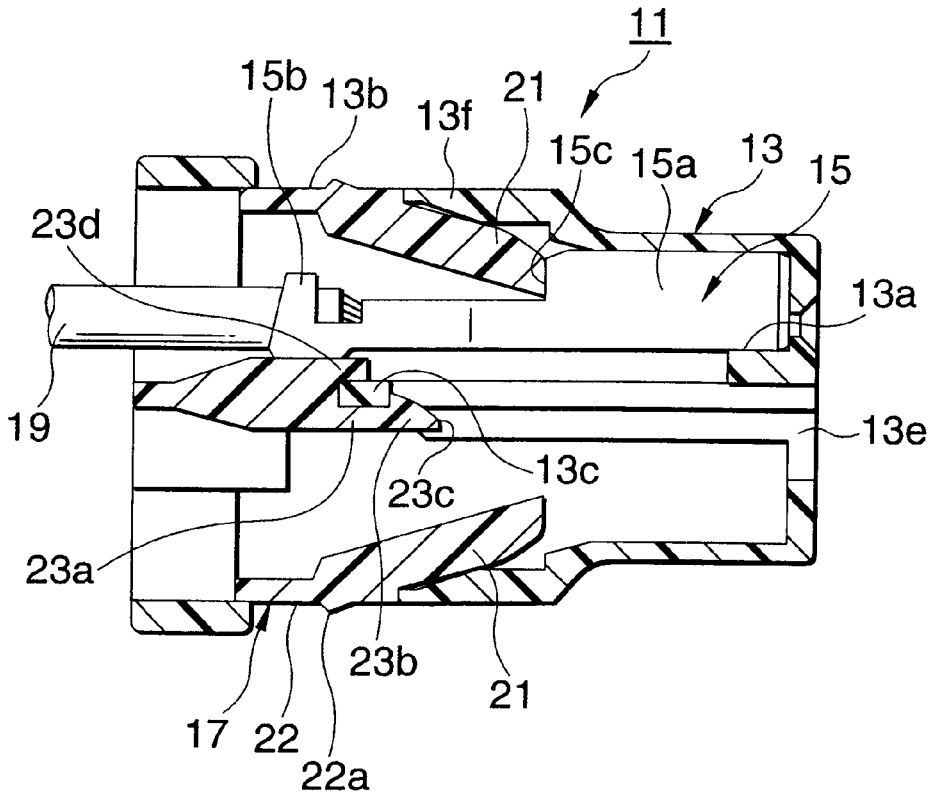
FIG. 2 is a vertical cross-sectional view of the terminal retainer-attached connector of FIG. 1 in its properly-assembled condition.
Figure 3:
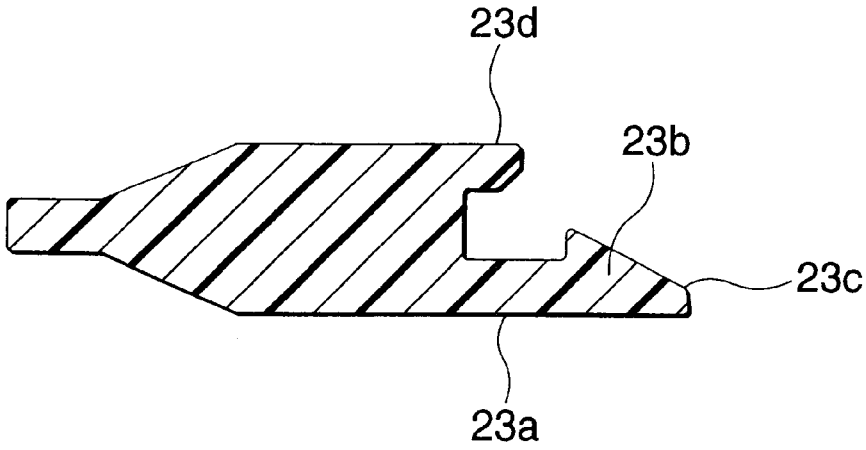
FIG. 3 is an enlarged view of an important portion of the terminal retainer-attached connector of FIG. 2.
Figure 4:
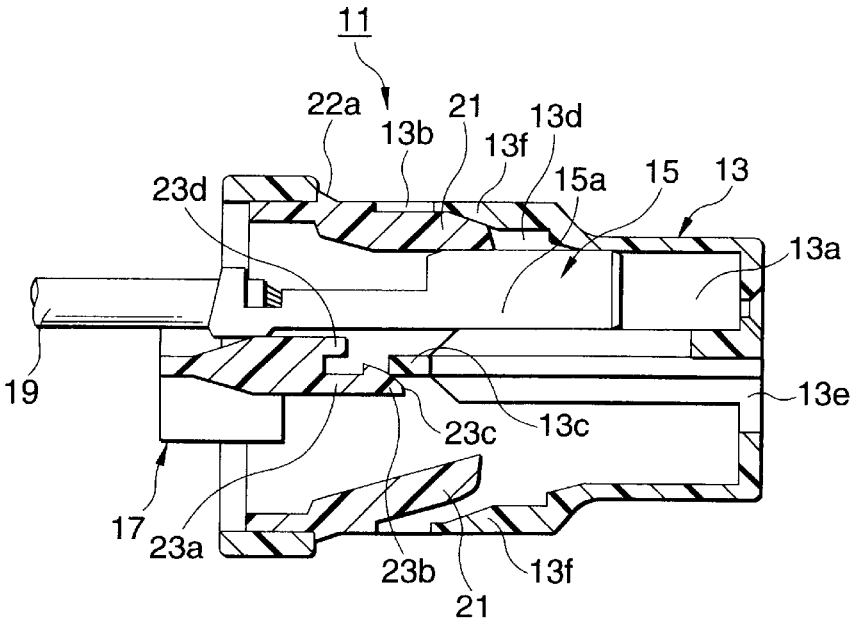
FIG. 4 is a vertical cross-sectional view of the terminal retainer-attached connector of FIG. 2, showing a terminal retainer in its provisionally-engaged condition.
Figure 5:
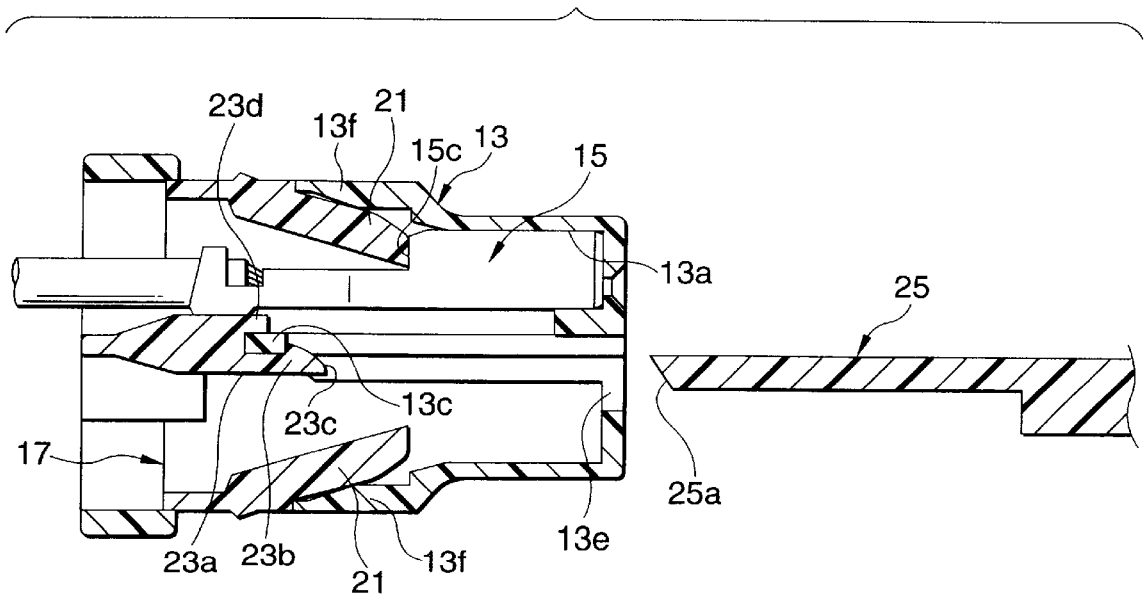
FIG. 5 is a vertical cross-sectional view of the terminal retainer-attached connector of FIG. 2, explaining an operation for canceling a completely-engaged condition of the terminal retainer.
Figure 6:
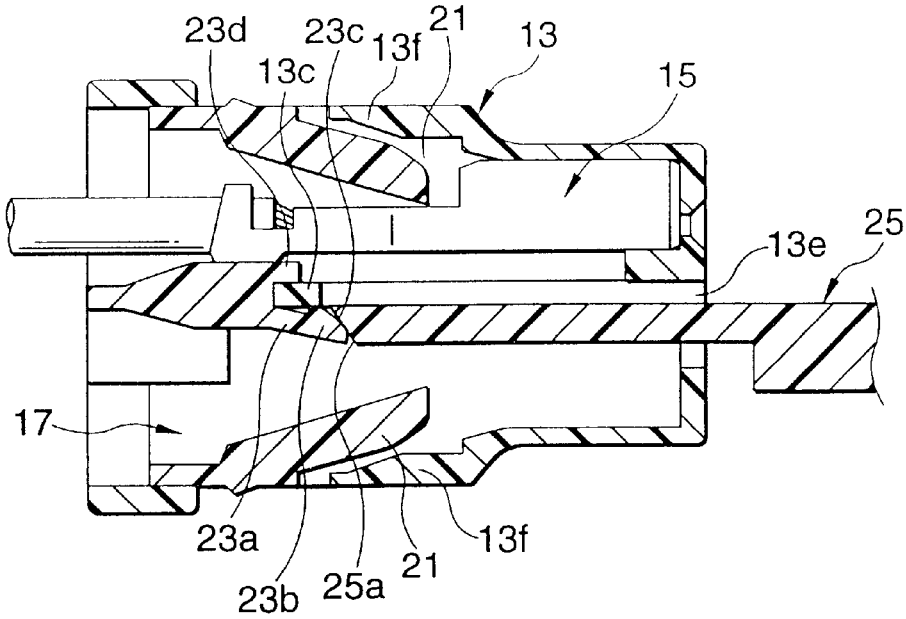
FIG. 6 is a vertical cross-sectional view of the terminal retainer-attached connector of FIG. 2, explaining the operation for canceling the completely-engaged condition of the terminal retainer.
Figure 7:
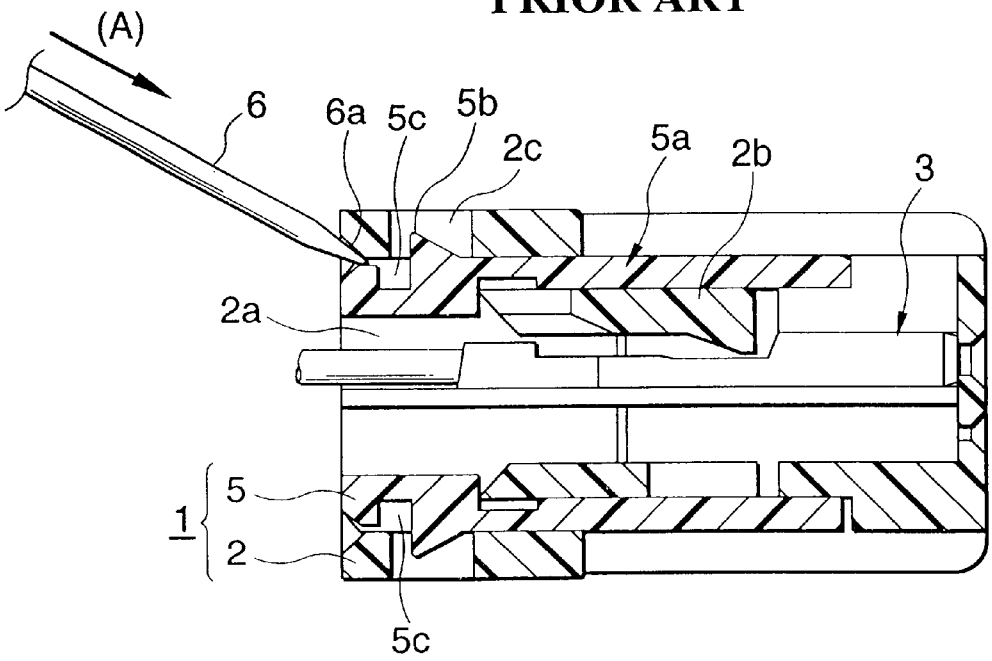
FIG. 7 PRIOR ART
FIG. 7 is a vertical cross-sectional view of a related, terminal retainer-attached connector.
Figure 8:
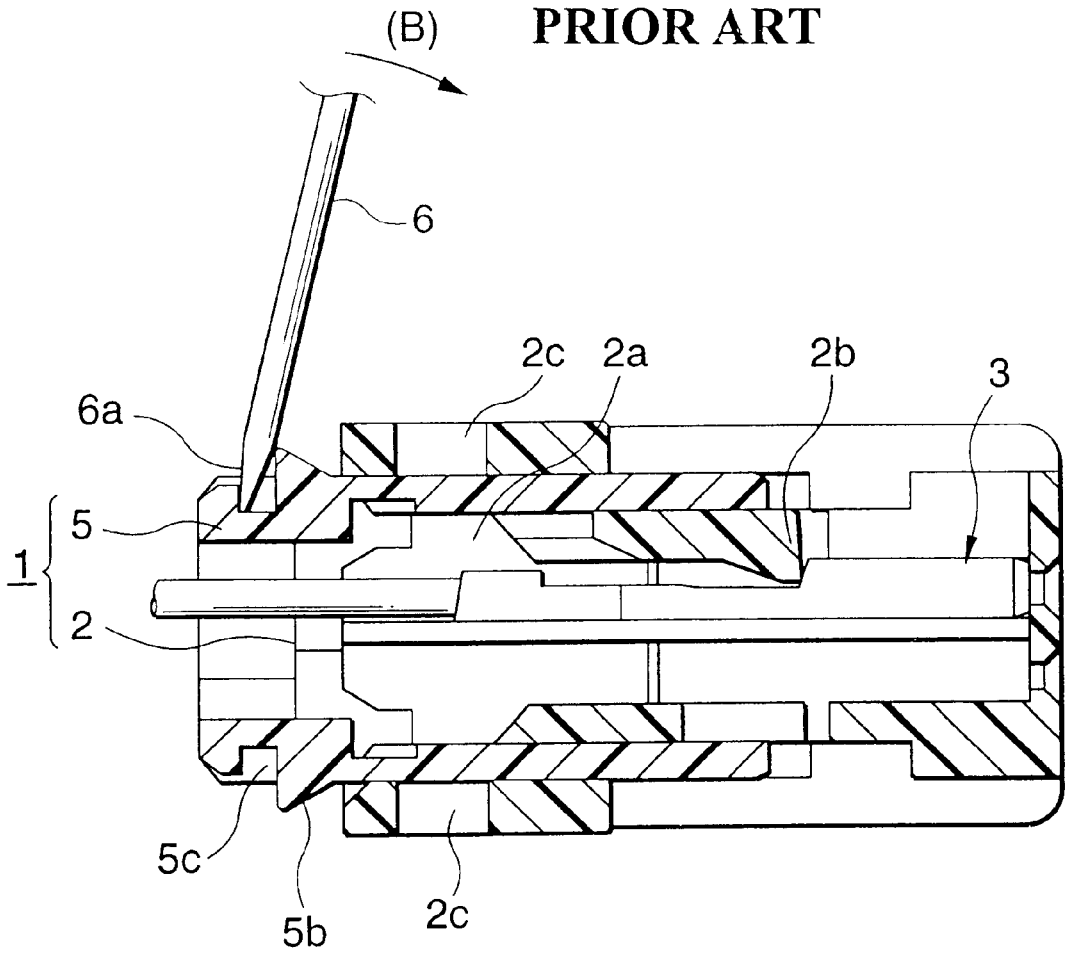
FIG. 8 PRIOR ART
FIG. 8 is a vertical cross-sectional view of the terminal retainer-attached connector of FIG. 7, explaining an operation for canceling a completely-engaged condition of a terminal retainer.

FIG. 1 is an exploded, front-elevational view of one preferred embodiment of the terminal retainer-attached connector of the present invention, FIG. 2 is a vertical cross-sectional view of the terminal retainer-attached connector of FIG. 1 in its properly-assembled condition, FIG. 3 is an enlarged view of an important portion of the terminal retainer-attached connector of FIG. 2, FIG. 4 is a vertical cross-sectional view of the terminal retainer-attached connector of FIG. 2, showing a terminal retainer in its provisionally-engaged condition, and FIGS. 5 and 6 are vertical cross-sectional views of the terminal retainer-attached connector of FIG. 2, explaining an operation for canceling a completely-engaged condition of the terminal retainer.

As shown in FIGS. 1 and 2, the terminal retainer-attached connector 11 of this embodiment comprises a connector housing 13, having a plurality of terminal receiving chambers 13*a*, and the terminal retainer 17 which is inserted into the connector housing 13 from the rear side (left side in the drawings) thereof to retain metal terminals 15 received respectively in the terminal receiving chambers 13*a*. As shown in FIG. 2, the metal terminal 15 is a female crimp-type terminal including a terminal fitting portion 15*a* for receiving a tongue-like tab terminal, and a wire clamping portion 15*b* for fixedly holding a wire 19.

The terminal retainer 17 includes a frame-like body 22 for fitting into an opening formed in the rear side of the connector housing 13, a plurality of terminal holding piece portions (elastic piece portions) 21 formed on and projecting from upper and lower walls of the body 22 in corresponding relation to the terminal receiving chambers 13*a*, respectively, and an elastic retaining piece portion 23*a* extending from a substantially central portion of the body 22 in a direction of insertion of the terminal retainer 17. This terminal retainer 17 is molded into an integral construction, using an insulative resin.

When the terminal retainer is inserted into a completely-engaging position within the terminal receiving chamber 13*a* as shown in FIG. 2, a distal end abutment portion 21*a* of each terminal holding piece portion 21 engages a step portion 15*c* of the metal terminal 15 to prevent the displacement of the metal terminal 15 toward the rear side (left side in the drawings) of the housing, and at the same time the terminal holding piece portion 2 is prevented by a housing inner wall 13*f*, bulging inwardly from an inner surface of the housing, from being elastically deformed in an engagement-canceling direction (toward the outer peripheral surface of the housing).

The elastic retaining piece portion 23*a* is of the cantilever type having a free or distal end, and when a completely-retaining portion 23*b*,formed at the distal end thereof, is engaged with a completely-engaging portion 13*c* of the connector housing 13 as shown in FIG. 2, the terminal retainer 17 is retained in the completely-engaging position relative to the connector housing 13.

The completely-engaging portion 13*c* is a beam portion of a rectangular cross-section extending within the housing in a direction of the width thereof (that is, in a direction perpendicular to the sheet of the drawings). The completely-retaining portion 23*b*,formed in a projected manner on the upper surface of the elastic retaining piece portion 23*a* at the distal end thereof, becomes engaged with the completely-engaging portion 13*c* from the lower side thereof.

As shown in FIG. 3, an engagement-canceling tapering portion 23*c* is formed at the distal end surface of the completely-retaining portion 23*b* formed at the distal end of the elastic retaining piece portion 23*a*. When this engagement-canceling tapering portion 23*c* is pressed by a distal end 25*a*of a removal jig 25, inserted through a jig insertion port 13*e* (which is formed in the front side (right side in the drawings) of the connector housing 13, and is disposed substantially in alignment with the engagement-canceling tapering portion 23*c* as described later), the elastic retaining piece portion 23*a* is retracted while elastically deformed in a direction to cause the completely-retaining portion 23*b* to be disengaged from the completely-engaging portion 13*c* of the connector housing 13.

The elastic retaining piece portion 23*a* can cooperate with a restraint projection 23*d*, formed substantially parallel thereto, to hold the completely-engaging portion 13*c* therebetween. More specifically, the distance between the elastic retaining piece portion 23*a* and the restraint projection 23*d* is substantially equal to the thickness of the completely-engaging portion 13*c*, and the elastic retaining piece portion 23*a* will not shake relative to the completely-engaging portion 13*c* in the elastically-deforming direction (upward-downward direction in the drawings).

Provisionally-retaining projections 22*a*, which are engageable respectively in provisionally-retaining holes 13*b* in the connector housing 13, are formed respectively on outer surfaces of upper and lower walls of the body 22. With this construction, the terminal retainer 17 can be moved relative to the rear portion of the connector housing 13 in a two-step manner, that is, between the completely-engaging position and a provisionally-engaging position (i.e., an engagement-canceling position where each housing inner wall 13*f* does not prevent the terminal holding piece portions 21 from being elastically deformed in the engagement-canceling direction as shown in FIG. 4).

As shown in FIG. 4, the terminal retainer 17 is beforehand attached to the rear portion of the connector housing 13, and the provisionally-retaining projections 22*a* are engaged respectively in the provisionally-retaining holes 13*b*, thereby holding the terminal retainer 17 in the provisionally-engaged condition. Then, the metal terminals 15 are inserted respectively into the terminal receiving chambers 13*a* from the rear side of the housing.

At this time, the terminal retainer 17 , disposed in the provisionally-engaged condition, is held in the engagement-canceling position where each terminal holding piece portion 21 is not prevented from being elastically deformed in the engagement-canceling direction, and therefore the terminal holding piece portion 21 is elastically deformed toward the outer peripheral surface of the housing (that is, upwardly in FIG. 4) by the terminal fitting portion 15*a* of the metal terminal 15 as shown in FIG. 4, and therefore will not prevent the insertion of the metal terminal 15.

Then, when the amount of insertion of the metal terminal 15 into the terminal receiving chamber 13*a* exceeds a predetermined value, the terminal holding piece portion 21 is elastically restored toward the inner portion of the housing, so that the distal end abutment portion 21*a* thereof is engaged with the step portion 15*c* to prevent the displacement of the metal terminal 15 toward the rear side (left side in the drawings) of the housing, thus retaining the metal terminal 15 against withdrawal.

Then, when the terminal retainer 17, together with the metal terminals 15, is inserted into the completely-engaging position, each terminal holding piece portion 21 is prevented by the housing inner wall 13*f* from being elastically deformed in the engagement-canceling direction (that is, toward the outer peripheral surface of the housing) as shown in FIG. 2, and at the same time the completely-retaining portion 23*b* of the elastic retaining piece portion 23*a* is engaged with the completely-engaging portion 13*c* of the connector housing 13, so that the terminal retainer 17 is completely retained, that is, disposed in the completely-engaged condition.

At this time, the engagement-canceling tapering portion 23*c*, formed at the distal end surface of the completely-retaining portion 23*b*, abuts against the completely-engaging portion 13*c*, so that the elastic retaining piece portion 23*a* is elastically deformed downwardly, and the completely-retaining portion 23*b* can become engaged with the completely-engaging portion 13*c* from the lower side thereof.

When the completely-retaining portion 23*b* is engaged with the completely-engaging portion 13*c*, the restraint projection 23*d* cooperates with the elastic retaining piece portion 23*a* to hold the completely-engaging portion 13*c* therebetween, and therefore the elastic retaining piece portion 23*a* will not shake in the elastically-deforming direction (upward-downward direction in FIG. 2).

Therefore, in the terminal retainer-attached connector 11 of this embodiment, the engagement of the completely-retaining portion 23*b* with the completely-engaging portion 13*c* will not be accidentally canceled by external vibrations or impact, so that the stable retaining force is obtained.

And besides, when the metal terminal 15 is incompletely mounted in the terminal receiving chamber 13*a*, so that the distal end abutment portion 21*a* of the terminal holding piece portion 21 is not completely engaged with the step portion 15*c* of the metal terminal 15 as shown in FIG. 4, the terminal holding piece portion 21 is held between the housing inner wall 13*f* and the terminal fitting portion 15*a*, so that the terminal retainer 17 can not be properly inserted, and therefore the incompletely-mounted condition of the metal terminal 15 can be detected.

For canceling the completely-engaged condition of the terminal retainer 17 so as to remove the metal terminal 15 when the metal terminal 15 is erroneously inserted or exchanged, the removal jig 25 is inserted through the jig insertion port 13*e*, formed in the connector housing 13, in a direction opposite to the direction of insertion of the terminal retainer 17 as shown in FIG. 5, and the engagement-canceling tapering portion 23*c*,formed at the distal end surface of the elastic retaining piece portion 23*a*,is pressed by the distal end 25*a* of this removal jig 25.

When the engagement-canceling tapering portion 23*c* of the elastic retaining piece portion 23*a* is thus pressed by the distal end 25*a* of the removal jig 25, the elastic retaining piece portion 23*a* is retracted while elastically deformed in the direction to cause the completely-retaining portion 23*b* to be disengaged from the completely-engaging portion 13*c* of the connector housing 13, so that the completely-engaged condition of the terminal retainer 17 relative to the connector housing 13 is canceled as shown in FIG. 6. Preferably, a tapering portion, which can be easily engaged with the engagement-canceling tapering portion 23*c*,is suitably formed at the distal end 25*c* of the removal jig 25.

Therefore, with only one operation, that is, merely by inserting the removal jig 25 through the jig insertion port 13*e* in the direction opposite to the direction of insertion of the terminal retainer 17, the engagement of the completely-retaining portion 23*b* with the completely-engaging portion 13*c* can be canceled, and also the terminal retainer 17 can be easily moved from the completely-engaging position to the provisionally-engaging position (i.e., the engagement-canceling position).

The completely-engaged condition of the terminal retainer 17 can be canceled through the elastic deformation of the elastic retaining piece portion 23*a*,and therefore an undue force will not act on the connector housing 13 and the terminal retainer 17, so that the connector housing 13 and the terminal retainer 17 will not be deformed.

Thus, the terminal retainer-attached connector 11 of this embodiment has the good retaining structure in which the retained condition of the terminal retainer 17 can be easily canceled when removing the metal terminals 15, and the connector housing 13 and the terminal retainer 17 will not be deformed.

In the terminal retainer-attached connector 11 of this embodiment, when the completely-retaining portion 23*b* is engaged with the completely-engaging portion 13*c*, the restraint projection 23*d* cooperates with the elastic retaining piece portion 23*a* to hold the completely-engaging portion 13*c* therebetween, and therefore the elastic retaining piece portion 23*a* will not shake in the elastically-deforming direction (upward-downward direction in FIG. 2).

Therefore, when the engagement-canceling tapering portion 23*c*,formed at the distal end surface of the elastic retaining piece portion 23*a*, is to be pressed by the distal end 25*a* of the removal jig 25, the removal jig 25 can be positively brought into an engaging position relative to the distal end surface of the elastic retaining piece portion 23*a*,and the elastic retaining piece portion 23*a* can be more positively elastically deformed in the engagement-canceling direction by the pressing force applied by the inserted -removal jig 25.

The connector housing, the terminal retainer, the metal terminals and so on of the terminal retainer-attached connector 11 of the present invention are not limited to those of the illustrated embodiment, but suitable modifications can be made without departing from the scope of the present invention.

For example, in the above embodiment, although in the provisionally-engaged condition of the terminal retainer 17, the distal end abutment portion 21*a* of the terminal holding piece portion 21 is engaged with the step portion 15*c* to prevent the metal terminal 15 from being displaced toward the rear side of the housing, there can be provided a construction in which in the provisionally-engaged condition, the terminal holding piece portion 21 is not engaged with the metal terminal 15, and when the terminal retainer 17 is inserted into the completely-engaging position, the terminal holding piece portion 21 is pressed in the engaging direction by the housing inner wall 13*f*, and is engaged with the metal terminal 15, thereby retaining the metal terminal 15 against withdrawal.

In the terminal retainer-attached connector of the present invention, for canceling the completely-engaged condition of the terminal retainer so as to remove the metal terminal, the removal jig is inserted through the jig insertion port, formed in the connector housing, in a direction opposite to the direction of insertion of the terminal retainer, and the engagement-canceling tapering portion, formed at the distal end surface of the elastic retaining piece portion is pressed by a distal end of this removal jig.

When the engagement-canceling tapering portion of the elastic retaining piece portion is thus pressed by the distal end of the removal jig, the elastic retaining piece portion is retracted while elastically deformed in the direction to cause the completely-retaining portion to be disengaged from the completely-engaging portion of the connector housing, so that the completely-engaged condition of the terminal retainer relative to the connector housing is canceled.

Therefore, with only one operation, that is, merely by inserting the removal jig through the jig insertion port in the direction opposite to the direction of insertion of the terminal retainer, the terminal retainer can be easily moved from the completely-engaging position to the engagement-canceling position.

The completely-engaged condition of the terminal retainer can be canceled through the elastic deformation of the elastic retaining piece portion, :and therefore an undue force will not act on the connector housing and the terminal retainer, so that the connector housing and the terminal retainer will not be deformed.

Therefore, there can be provided the terminal retainer-attached connector having the good retaining structure in which the retained condition of the terminal retainer can be easily canceled when removing the metal terminals, and the connector housing and the terminal retainer will not be deformed.

What is claimed is:

1. A connector, comprising:

a connector housing including a terminal receiving chamber into which a metal terminal is insertable, a completely-engaging portion, and a jig insertion port through which a removal jig is insertable in the connector housing;

a terminal retainer attachable to the connector housing to retain the metal terminal in the terminal receiving chamber; and an elastic retaining piece portion formed on the terminal retainer to extend in an attaching direction thereof, the elastic retaining piece portion having a completely-retaining portion at a distal end thereof and an engagement-canceling tapering portion on a distal end surface thereof, wherein the completely-retaining portion is engageable with the completely-engaging portion of the connector housing to retain the terminal retainer in a completely-engaging position relative to the connector housing, and when the engagement-canceling tapering portion is pressed by the removal jig inserted in the connector housing through the jig insertion port so as to be disposed substantially in alignment with the engagement-canceling tapering portion, the elastic retaining piece portion is retracted while elastically deformed in a direction causing the completely-retaining portion to be disengaged from the completely-engaging portion.

2. The connector of claim 1, further comprising a restraint projection formed substantially parallel to the elastic retaining piece portion, wherein the elastic retaining piece portion cooperates with the restraint projection to hold the completely-engaging portion therebetween.

3. The connector of claim 1, wherein the terminal retainer includes a terminal holding piece portion, which engages the metal terminal to prevent displacement of the metal terminal and is prevented by an inner wall of the connector housing from being elastically deformed in an engagement-canceling direction when the terminal retainer is inserted into the completely-engaging position within the connector housing.

4. The connector of claim 1, wherein the terminal retainer is attachable to a rear side of the connector housing and wherein the jig insertion port is provided in the front side of the connector housing, opposite said rear side.

5. A connector, comprising:

a connector housing including a terminal receiving chamber into which a metal terminal is insertable, and a completely-engaging portion formed in the connector housing; and a terminal retainer attachable to the connector housing to retain the metal terminal in the terminal receiving chamber, the terminal retainer including:

a terminal holding piece portion, which engages the metal terminal to prevent displacement of the metal terminal and is prevented by an inner wall of the connector housing from being elastically deformed in an engagement-canceling direction when the terminal retainer is inserted into a completely-engaging position within the connector housing, and an elastic retaining piece portion, which extends in an attaching direction of the terminal retainer, and has a completely-retaining portion formed at a distal end of the elastic retaining piece portion, the completely-retaining portion engageable with the completely-engaging portion of the connector housing to retain the terminal retainer in the completely-engaging position relative to the connector housing, wherein the elastic retaining piece portion has an engagement-canceling tapering portion at a distal end surface thereof, and when the engagement-canceling tapering portion is pressed by a removal jig, inserted through a jig insertion port formed in the connector housing, and disposed substantially in alignment with the engagement-canceling tapering portion, the elastic retaining piece portion is retracted while elastically deformed in a direction to cause the completely-retaining portion to be disengaged from the completely-engaging portion.

6. The connector of claim 5, further comprising a restraint projection formed substantially parallel to the elastic retaining piece portion, wherein the elastic retaining piece portion cooperates with the restraint projection to hold the completely-engaging portion therebetween.

7. The connector of claim 5, wherein the terminal retainer is attachable to a rear side of the connector housing and wherein the jig insertion port is provided in the front side of the connector housing, opposite said rear side.

* * * * *